United States Patent [19]

Gartside et al.

[11] Patent Number: 4,585,544

[45] Date of Patent: Apr. 29, 1986

[54] HYDROCARBON PRETREATMENT PROCESS FOR CATALYTIC CRACKING

[75] Inventors: Robert J. Gartside, Wellesley, Mass.; Axel R. Johnson, North Babylon, N.Y.; Joseph L. Ross, Houston, Tex.; Dennis A. Duncan, Sharon, Mass.; Edwin J. Bassler, Summit, N.J.

[73] Assignee: Stone & Webster Engineering Corporation, Boston, Mass.

[21] Appl. No.: 587,937

[22] Filed: Mar. 9, 1984

[51] Int. Cl.[3] ..... C10G 51/04

[52] U.S. Cl. ..... 208/73; 208/75; 208/91; 208/127; 208/251 R

[58] Field of Search ..... 208/67, 73, 75, 127, 208/126, 106, 72, 91, 85, 55, 251 R

[56] References Cited

U.S. PATENT DOCUMENTS

| | | | |
|---|---|---|---|
| 3,162,593 | 12/1964 | Persyn | 208/127 |
| 3,537,975 | 11/1970 | Blaser | 208/127 |
| 4,049,540 | 9/1977 | Ueda et al. | 208/127 |
| 4,263,128 | 9/1981 | Bartholic | 208/127 |
| 4,309,272 | 1/1982 | Johnson et al. | 208/72 |
| 4,311,579 | 1/1982 | Bartholic | 208/73 |
| 4,311,580 | 1/1982 | Bartholic | 208/91 |
| 4,318,800 | 3/1982 | Woebcke et al. | 208/127 |
| 4,325,817 | 4/1982 | Bartholic et al. | 208/164 |
| 4,435,272 | 3/1984 | Bartholic et al. | 208/127 |

OTHER PUBLICATIONS

Hydrocarbon Processing 1984 Refining Process Handbook, Sep. 1984, p. 139.

Schuetze & Hofmann, Hydrocarbon Processing, "How to Upgrade Heavy Feed", Feb., 1984, p. 79, Table 4.

Andrew Stasio, Undated Englehard Papers–Application of the Art Process to Upgrade Tar Sands Bitumen, pp. 1–9.

Oil & Gas Journal, "New Crude/Resid Treating Process Offers Savings", Nov. 9, 1981, pp. 1–4.

Fujita, et al., Undated, Production of Olefins by Thermal Cracking of Heavy Oils Through a Fluidized Bed of Circulating Coke Particles (KK), pp. 20, 21.

*Primary Examiner*—Andrew H. Metz

*Assistant Examiner*—Anthony McFarlane

*Attorney, Agent, or Firm*—Hedman, Gibson, Costigan & Hoare

[57] ABSTRACT

A process for pretreating residual oil by thermal regenerative vaporizing and pretreatment at short residence times and catalytically cracking the pretreated effluent from the thermal regenerative pretreatment process.

17 Claims, 5 Drawing Figures

HYDROCARBON PRETREATMENT PROCESS FOR CATALYTIC CRACKING

FIELD OF INVENTION

This invention relates to the production of commercial hydrocarbon fuels such as gasoline. More particularly, the invention relates to the production of gasoline and other hydrocarbon fuels by a catalytic cracking process. Most specifically, the invention relates to the production of gasoline from residual oil wherein the residual oil is pretreated in a thermal regenerative cracking process prior to final catalytic cracking.

DESCRIPTION OF THE PRIOR ART

Commercial hydrocarbon fuels, such as gasoline, are produced from heavier hydrocarbon feeds. Typically, the hydrocarbon feed is obtained from a naturally occurring source and is thus, comprised of a diverse mixture of hydrocarbons which vary widely in molecular weight and therefore boil over a wide temperature range. The hydrocarbons from a natural source usually also contain impurities.

The processes for producing commercial fuels such as gasoline have been well developed over the years. In general, the processes for producing gasoline are catalytic cracking processes in which a catalyst and the hydrocarbon feed are joined in a reactor at a high temperature to vaporize the hydrocarbon feed and crack the heavy molecules to smaller molecules capable of boiling in the range appropriate for practical commercial application. Reactors for catalytic cracking can take the form of fixed bed reactors or riser reactors wherein the feed and catalyst travel co-currently at elevated temperatures for a sufficient time to achieve the necessary cracking reaction.

After the cracking reaction, the catalyst must be separated from the reacted hydrocarbon products and typically regenerated and recycled back to the reactor for continuous use.

All naturally occurring hydrocarbon feeds contain coke forming materials, sulfur and metals, both heavy and light, which tend to contaminate the catalyst during the catalytic cracking reaction. The heavier hydrocarbons generally contain a greater quantity of coke percursors (asphaltenes, polynuclear aromatics, etc.) and heavy metals which are not conveniently removed by any of the current pretreatment methods.

Thus, it is desirable to use as a feed for catalytic cracking the lower boiling hydrocarbons which contain fewer of the problem contaminates. However, as the lower boiling naturally occurring hydrocarbons are consumed, the petroluem industry is beginning to use the heavier hydrocarbons; i.e., residual oils., The hydrocarbon feeds identified as residual oils customarily include residual, reduced crude oils, atmospheric tower bottoms, toppped crudes, vacuum resids and most other hydrocarbons heavier than a gas oil.

A number of process routes have been developed to pretreat these residual oils prior to cracking in a primary processing unit. Solvent deasphalting, fluid or delayed coking and hydrotreating are current pretreating processes for upgrading residual oils for catalytic cracking.

Solvent deasphalting and fluid or delayed coking are essentially carbon rejection process. As a result of the temperatures and residence times involved in these processes, substantial loss of material boiling in the range of the initial feedstock will occur and a significant amount of thermal degradation and rearrangement will also occur.

Hydrotreating results in the excessive formation of light gaseous hydrocarbon products and is particularly costly in terms of hydrogen and catalyst consumption because of the poisonous effect of the contaminates contained in the residual oils.

SUMMARY OF THE INVENTION

It is an object of the present invention to substantially reduce heavy metalic contaminates, sulfur and a majority of the coke precursers (asphaltenes, polynuclear aromatics) from hydrocarbon feedstocks and particularly from residual oils.

It is another object of the invention to provide a pretreatment process for hydrocarbon feedstocks generally and for residual oils in particular in which the contaminants are removed from the feedstocks with minimal destructive effect on the normally liquid hydrocarbon components.

It is a further object of the present invention to provide a process in which coke precursors, sulfur and heavy metal contaminants are removed from residual oils and the resultant feed is cracked in a catalytic reactor to produce gasoline.

It is another object to minimize the hydrogen loss to coke and light gases in a hydrocarbon pretreatment process.

The process of the present invention contemplates a very short and intimate contact time between solid particles and hydrocarbon feed, such as residual oil, at elevated temperatures to substantially vaporize valuable oils. Non-volatiles containing the bulk of the feed contaminants (i.e. metals, carbon residue, etc.) are reduced to coked products and coke on the solids which is burned in the regenerator to supply process heat. The reactor residence time is in the range of 0.05 to 0.50 and preferably 0.05 to 0.20 seconds to minimize vapor phase cracking of the vaporized oils, the temperature is in the range of 850° F. to 1200° F. to maximize vaporization and preferably 1000° F. to 1200° F. and the pressure is from 0 psig to 350 psig. A solids to hydrocarbon weight ratio of 3 to 60 and preferably 5 to 30 is used. The process is beneficially conducted in a thermal regenerator cracking (TRC) reactor system in which the solids and heavy hydrocarbon feed are fed through an intimate mixing chamber into the top of a transfer line reactor. The transfer line reactor terminates in a separation zone wherein the pretreated gases are rapidly and efficiently separated from the solids and delivered either directly to a catalytic cracking reactor or stored for future cracking.

After separation, the particulate solids are stripped of gaseous hydrocarbons, and then passed through a transport line to the heating receptacle. The carbon deposits on the solids are burned from the solids in either the transport line or the heating receptacle to provide the heat necessary for the transfer line reactor. The flue gas generated by the burning of coke will contain sulfur removed from the heavy hydrocarbon, various carbon oxides such as carbon monoxide and carbon dioxide and steam. The sulfur is recovered downstream in conventional sulfur recovery equipment and the carbon monoxide, if present, is delivered to heat generation equipment to be burned as a fuel.

One embodiment of the invention is comprised of a process in which the hydrocarbon pretreatment processing is closely coupled with a catalytic cracking reactor. Therein, the product leaving the TRC pretreatment system is in the gas phase at a temperature between 700° F. and 1100° F. The gaseous product is delivered to the catalytic cracking reactor with catalyst particles at a temperature of 1000° to 1700° F. in a ratio of 0.1 to 20 lbs. catalyst to 1 lb. gas feed. The close coupling provides for more efficient energy utilization and improved catalytic cracking by eliminating feed vaporization requirements.

DESCRIPTION OF THE DRAWINGS

The subject invention will be better understood when considered with the accompanying drawings.

DESCRIPTION OF PREFERRED EMBODIMENT

The process of the subject invention is directed principally to the pretreatment of heavy hydrocarbon feeds for catalytic cracking to produce commercial fuels, such as gasoline. The feeds contemplated for pretreatment are the residual oils which are heavier and boil at higher temperatures than gas oils. However, the process is suitable for use in pretreating any hydrocarbon feed that contains sulfur, heavy metals or coke precursors.

Figure 1:
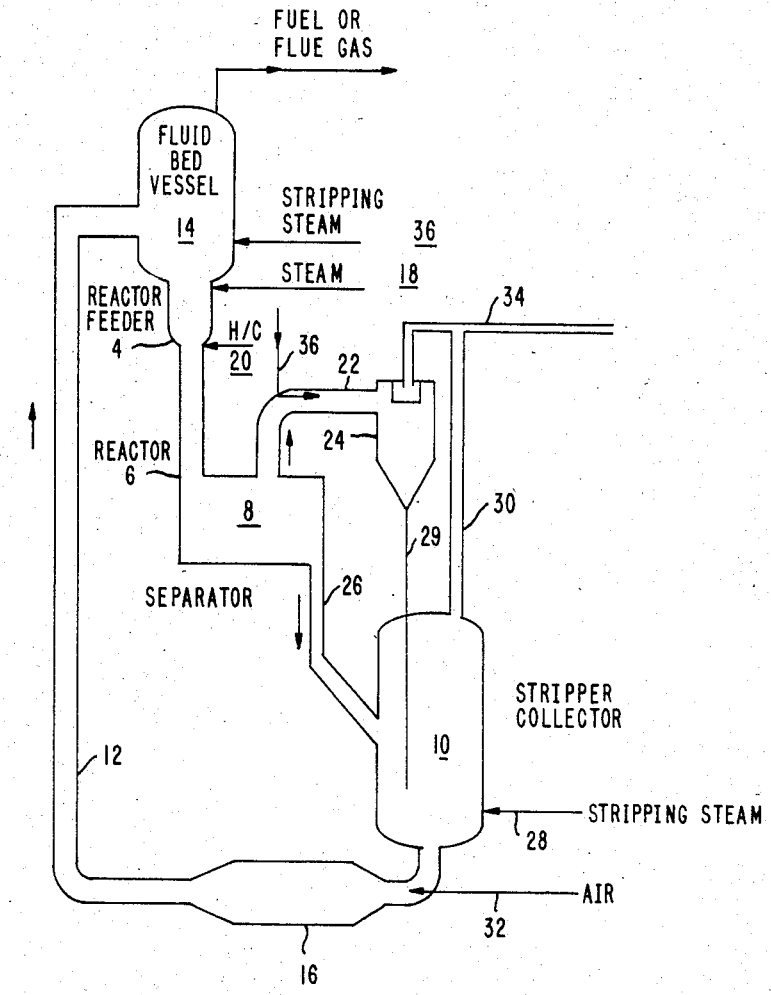
FIG. 1 is an overall schematic view of the process and equipment of the hydrocarbon feed pretreatment system.

As best seen in FIG. 1, the hydrocarbon feed pretreatment system 2 includes principally a reactor feeder 4, a transfer line reactor 6, a separator 8, a stripper 10, a transport line 12 and fluid bed receptacle 14. The transport line 12, may optionally include an entrained bed heater 16.

In the hydrocarbon feed pretreatment process, the particulate solids are heated to a temperature in the range up to 1800° F. and fed through the reactor feeder 4 (seen in detail in FIG. 3) to the reactor 6 simultaneously with the hydrocarbon feed. Steam to provide incipient localized fluidization of the particulate solids in the reactor feeder 4 is delivered to the reactor feeder 4 through a line 18.

The hydrocarbon feed is delivered to the reactor 6 through a line 20. The hydrocarbon feed is preheated to a temperature of 200° F. to 1000° F. and preferably 600° F. to 800° F. before delivery to the reactor 6. The weight ratio of particulate solids to hydrocarbon feed in the reactor 6 is 3 to 60 and preferably 5 to 30 and most preferably 5 to 15 to achieve a reaction temperature of 900° F. to 1200° F., and preferably 1000° F. to 1200° F.

The residence time of the feed in the reactor 6 is 0.05 to 0.50 seconds and preferably 0.05 to 0.20 seconds. The pressure in the reactor is 0 to 350 psig.

Figure 4:
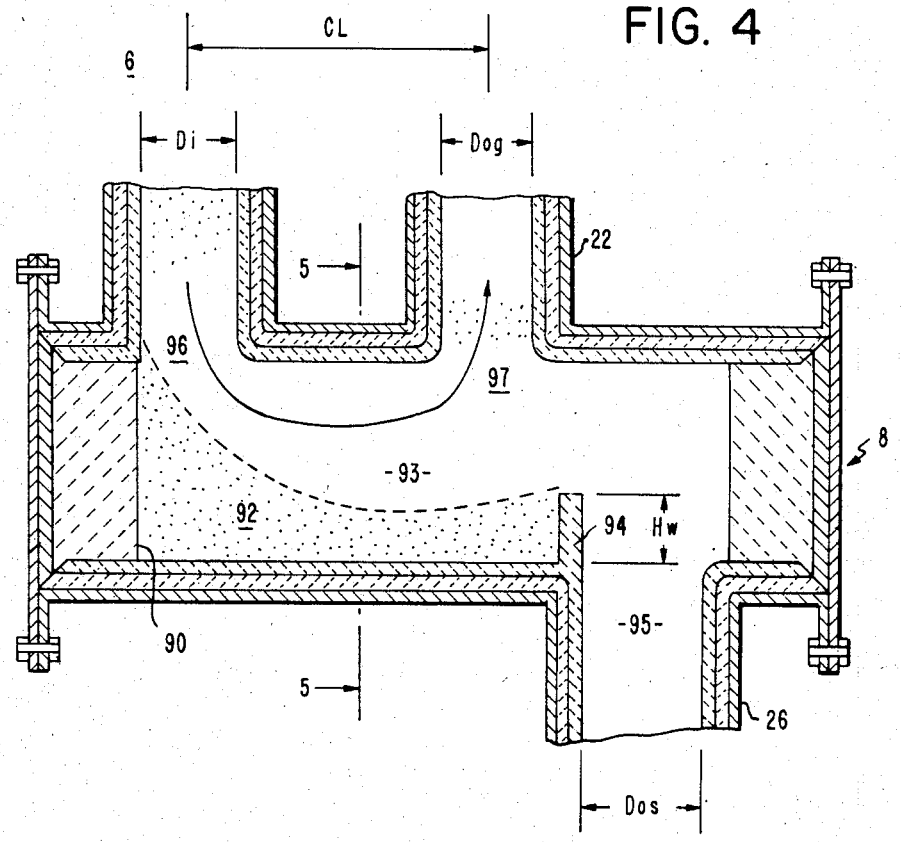
FIG. 4 is a cross-sectional view of the TRC separator of the hydrocarbon pretreatment system.

Thereafter, the particulate solids and reaction products are separated in the separator 8, seen in detail in FIG. 4.

The overhead leaving the separator 8 through the cyclone 24 is immediately quenched to a temperature of 650 to 850, preferably 750 to 800, to terminate the cracking reaction. Quench may be effected either by direct or indirect quench. An initial direct quench is illustrated by delivery of quench medium to the overhead line 22 through line 36 which occurs prior to the final quench in line 34.

The overhead gaseous product from the separator 8 passes through line 22 to a cyclone separator 24 to effect removal of any entrained solids particles. The particulate solids from the separator 8 pass through line 26 to the stripper 10. The entrained particulate solids removed from the gaseous overhead in the cyclone separator 24 are also delivered to the separator 10 through a separate line 29.

An inert gas, such a steam, is delivered to the bottom of the stripper—collector 10 through a line 28. The steam is at a temperature of about 300° F. to 900° F. and a pressure of 10 to 100 psig. The steam passes through the bed of particulate solids in the stripper—collector 10, strips the impurities from the solids and exits with the impurities overhead through a discharge line 30.

The stripped inert particles enter the transfer line 12 and are carried by transport gas entering the transfer line 12 through a line 32. The particulate solids are reheated either in the transfer line 12 by the combustion of the carbon (coke) on the particulate solids or heated in the fluid bed heater 14. Under the conditions of the process of the invention the coke make on the solid is 2 to 8 wt % of hydrocarbon feed. The temperature of the particulate solids discharged from the stripper—collector, is 900 to 1200. The combustion of the carbon on the coke elevates the temperature of the particulate solids to from 1200° F. to 1400° F. for delivery to the reactor. Under the condition of the process of the present invention, the preferred particulate solids to feed weight ratio is 5 to 30 and most preferably 5 to 15.

The overhead leaving the cyclone stripper 24 through line 34 has a composition higher in original feed material boiling range (650° F.+) and less coke and light gases than other known residual oil pretreatment processes.

Figure 2:
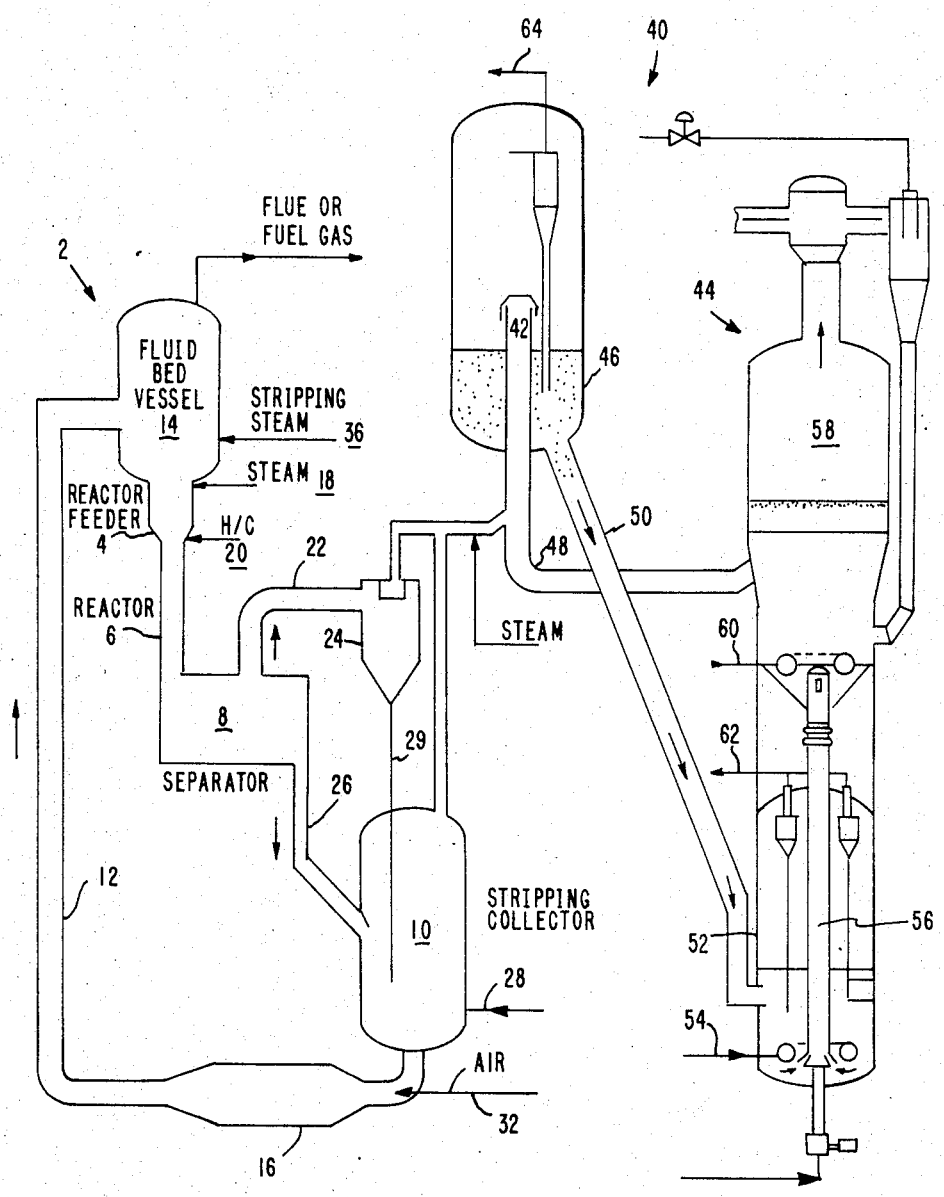
FIG. 2 is an overall schematic view of the process and equipment of the integrated hydrocarbon feed pretreatment system and the catalytic cracking system.

In the embodiment of FIG. 2, the TRC pretreated process system is shown close coupled with a catalytic cracking reactor system 40. The catalytic cracking reactor system 40 may be of any type, however, the Fluid Catalytic Cracking (FCC) reactor-regenerator of U.S. Letters Pat. Nos. 4,332,674; 4,336,160; 4,331,533 (Dean et al), incorporated herein by reference, is illustrated in FIG. 2 as particularly suitable.

The FCC system 40 includes essentially a riser reactor 42, a spent catalyst regenerator assembly 44 and a stripper 46. The regenerated catalyst is delivered to the riser reactor 42 through a line 48 and the pretreated hydrocarbon feed is delivered to the reactor 42 through line 34 from the pretreatment system 2. The catalyst and hydrocarbon feed travel upwardly through the riser reactor 42 and are separated upon discharge, the direction of the spent catalyst solids being reversed to pass downwardly to the stripper 46 and then through a line 50 to the first regenerator vessel 52 of the regenerator assembly 44.

The pretreatment system 2 of FIG. 2 is the same as the pretreatment system of FIG. 1 with the hot solids to feed weight ratio of 3 to 60 and preferably 20 to 30; the reaction temperature 800° F. to 1300° F.; the reactor pressure 10 psig to 100 psig.

Partial regeneration of spent catalyst occurs in the first regenerator 52 by partial combustion of the carbon on the spent catalyst with an oxygen deficient regeneration gas delivered through a line 54. The partially regenerated catalyst is delivered through a riser 56 to the second stage regeneration vessel 58 where complete regeneration is effected at high temperatures with an oxygen rich stream delivered through a line 60. Fuel gas rich in CO is taken from the first stage regenerator 52 through line 62 for use as fuel in ancillary equipment. The flue gas from the second stage regenerator is essentially free of CO and can be vented to the atmosphere.

The cracked product from the reactor riser 42 is separated from the spent catalyst and taken overhead through a line 64 for downstream processing.

In the process, of FIG. 2, hydrocarbon feed is pretreated in the reactor 6 at a temperature 850° F. to 1200° F. and preferably 900° F. to 1100° F., and a residence time of 0.05 to 0.50 and preferably 0.05 to 0.20 seconds with a solids to feed weight ratio of 3 to 60 and preferably 5 to 30. The cracked product is separated from the particulate solids in separator 8 and immediately delivered to the riser reactor 42 of the catalytic cracking unit.

Carbon on the inert solids discharged from the separator 8 is 2 to 10 weight percent.

The reaction product is delivered through the overhead line 34 directly to the catalytic cracking reactor 42 at a temperature of 700° F. to 1100° F. Catalyst at 1000° F. to 1700° F., in the weight ratio to feed of 0.1 to 20 is introduced into the catalytic reactor 42 with the reaction product from the pretreatment system 2.

The reaction product is catalytically cracked at 950° to 1150° F. in 0.1 to 2.0 seconds at 0 psig to 350 psig.

The coke make on the catalyst is 0 to about 5 wt % of feed or more.

The process of the present invention can rely on the apparatus developed for TRC processing. U.S. Letters Pat. Nos. 4,318,800; 4,370,303; 4,338,187; 4,352,728; 4,288,235 disclose the TRC process and apparatus and are incorporated herein by reference.

Figure 3:
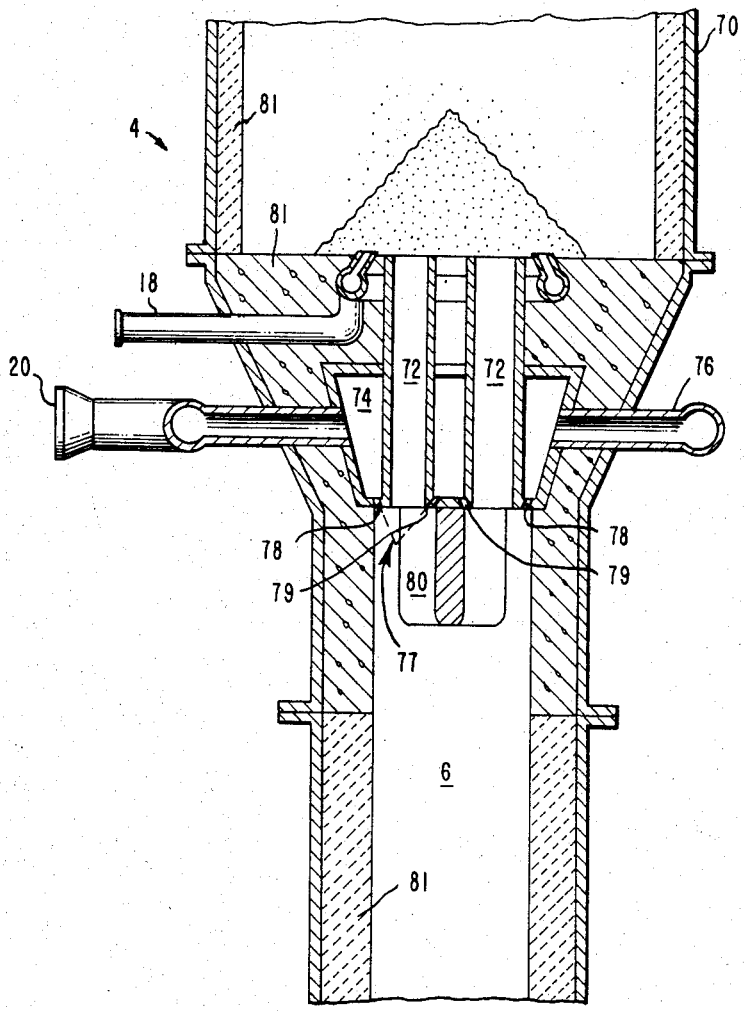
FIG. 3 is a cross-sectional elevational view of one embodiment of a TRC reactor of the hydrocarbon pretreatment system.

The reactor feeder of the TRC processing system is particularly well suited for use in the system due to the capacity to rapidly admix hydrocarbon feed and particulate solids. As seen in FIG. 3, the reactor feeder 4 delivers particulate solids from a solids receptacle 70 through vertically disposed conduits 72 to the reactor 6 and simultaneously delivers hydrocarbon feed to the reactor 6 at an angle into the path of the particulate solids discharging form the conduits 72. An annular chamber 74 to which hydrocarbon is fed by a toroidal feed line 76 terminates in angled openings 78. A mixing baffle or plug 80 also assists in effecting rapid and intimate mixing of the hydrocarbon feed and the particulate solids. The edges 79 of the angled openings 78 are preferably convergently beveled, as are the edges 79 at the reactor end of the counduits 72. In this way, the gaseous stream from the chamber 74 is angularly injected into the mixing zone and intercepts the solids phase flowing from conduits 72. A projection of the gas flow would form a cone shown by dotted lines 77, the vortex of which is beneath the flow path of the solids. By introducing the gas phase angularly, the two phases are mixed rapidly and uniformly, and form a homogeneous reaction phase. The mixing of a solid phase with a gaseous phase is a function of the shear surface between the solids and gas phases, and the flow area. As ratio of shear surface to flow area (S/A) of infinity defines perfect mixing; poorest mixing occurs when the solids are introduced at the wall of the reaction zone. In the system of the present invention, the gas stream is introduced annularly to the solids which ensures high shear surface. By also adding the gas phase transversely through an annular feed means, as in the preferred embodiment, penetration of the phases is obtained and even faster mixing results. By using a plurality of annular gas feed points and a plurality of solid feed conduits, even greater mixing is more rapidly promoted, since the surface to area ratio for a constant solids flow area is increased. Mixing is also a known function of the L/D of the mixing zone. A plug creates an effectively reduced diameter D in a constant L, thus increasing mixing.

The plug 80 reduces the flow area and forms discrete mixing zones. The combination of annular gas addition around each solids feed point and a confined discrete mixing zone greatly enhances the conditions for mixing. Using this preferred embodiment, the time required to obtain an essentially homogenous reaction phase in the reaction zone is quite low. Thus, this preferred method of gas and solids addition can be used in reaction systems having a residence time below 1 second, and even below 100 milliseconds.

Because of the environment of the reactor 6 and reactor feeder 4, the walls are lined with an inner core 81 of ceramic material. The detail of the reactor feeder is more fully described in U.S. Letters Pat. No. 4,388,187, which is incorporated herein by reference.

The separator 8 of the TRC system seen in FIG. 4, can also be relied on for rapid and discrete separation of cracked product and particulate solids discharging from the reactor 6. The inlet to the separator 8 is directly above a right angle corner 90 at which a mass of particulate solids 92 collect. A weir 94 downstream from the corner 90 facilitates accumulation of the mass of solids 92. The gas outlet 22 of the separator 8 is oriented 180° from the separator gas-solids inlet 96 and the solids outlet 26 is directly opposed in orientation to the gas outlet 22 and downstream of both the gas outlet 22 and the weir 94. In operation, centrifugal force propels the solid particles to the wall opposite inlet 96 of the chamber 93 while the gas portion having less momentum, flows through the vapor space of the chamber 93. Initially, solids impinge on the wall opposite the inlet 96 but subsequently accumulate to form a static bed of solids 92 which ultimately form in a surface configuration having a curvilinear arc of approximately 90° of a circle. Solids impinging upon the bed 92 are moved along the curvilinear arc to the solids outlet 95, which is preferably oriented for downflow of solids by gravity. The exact shape of the arc is determined by the geometry of the particular separator and the inlet stream parameters such as velocity, mass flowrate, bulk density, and particle size. Because the force imparted to the incoming solids is directed against the static bed 92 rather than the separator 8 itself, erosion is minimal. Separator efficiency, defined as the removal of solids from the gas phase leaving through outlet 97 is, therefore, not affected adversely by high inlet velocities, up to 150 ft./sec., and the separator 8 is operable over a wide range of dilute phase densities, preferably between 0.1 and 10.0 lbs./ft$^3$. The separator 8 of the present invention achieves efficiencies of about 80%, although the preferred embodiment, can obtain over 90% removal of solids.

It has been found that separator efficiency is dependent upon separator geometry, and more particularly, the flow path must be essentially rectangular, and there is an optimum relationship between the height H and the sharpness of the U-bend in the gas flow.

It has been found that for a given height H of chamber 93, efficiency increases as the 180° U-bend between inlet 96 and outlet 97 is brought progressively closer to inlet 96. Thus, for a given H the efficiency of the separator increases as the flow path decreases and, hence, residence time decreases. Assuming an inside diameter $D_i$ of inlet 96, the preferred distance CL between the centerlines of inlet 96 and outlet 97 is not greater than 4.0 $D_i$, while the most preferred distance between said centerlines is between 1.5 and 2.5 $D_i$. Below 1.5 $D_i$ better separation is obtained but difficulty in fabrication makes this embodiment less attractive in most instances. Should this latter embodiment be desired, the separator 8 would probably require a unitary casting design because inlet 96 and outlet 97 would be too close to one another to allow welded fabrication.

It has been found that the height of flow path H should be at least equal to the value of $D_i$ or 4 inches in height, whichever is greater. Practice teaches that if H is less than $D^i$ or 4 inches the incoming stream is apt to disturb the bed solids 92 thereby reentraining solids in the gas product leaving through outlet 97. Preferably H is on the order of twice $D_i$ to obtain even greater separation efficiency. While not otherwise limited, it is apparent that too large an H eventually merely increases residence time without substantive increases in efficiency. The width W of the flow path is preferably between 0.75 and 1.25 times $D_i$ most preferably between 0.9 and 1.10 $D_i$.

Outlet 97 may be of any inside diameter. However, velocities greater than 75 ft./sec. can cause erosion because of residual solids entrained in the gas. The inside diameter of outlet 97 should be sized so that a pressure differential between the stripping vessel 10 shown in FIG. 1 and the separator 8 exist such that a static height of solids is formed in solids outlet line 26. The static height of solids in line 26 forms a positive seal which prevents gases from entering the stripping vessel 10. The magnitude of the pressure differential between the stripping vessel 10 and the separator 8 is determined by the force required to move the solids in bulk flow to the solids outlet 95 as well as the height of solids in line 26. As the differential increases the net flow of gas to the stripping vessel 10 decreases. Solids, having gravitational momentum, overcome the differential, while gas preferentially leaves through the gas outlet.

Figure 5:
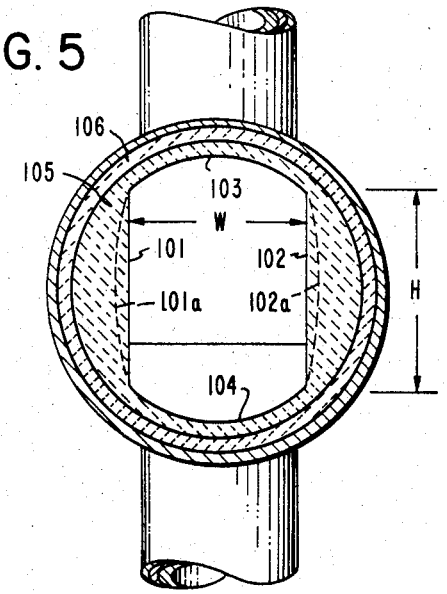
FIG. 5 is a sectional view through line 5—5 of FIG. 4.

FIG. 5 shows a cutaway view of a the separator along section 5—5 of FIG. 4. It is essential that longitudinal side walls 101 and 102 should be rectilinear, or slightly arcuate as indicated by the dotted lines lO*la* and 102*a*. Thus, the flow path through the separator 8 is essentially rectangular in cross section having a height H and width W as shown in FIG. 5. The embodiment shown in FIG. 5 defines the geometry of the flow path by adjustment of the lining width for walls 101 and 102. Alternatively, baffles, inserts, weirs or other means may be used. In like fashion the configuration of walls 103 and 104 transverse to the flow path may be similarly shaped, although this is not essential.

The separator shell and manways are preferably lined with erosion resistent linings 105, which may be required if solids at high velocities are encountered. Typical commercially available materials of or erosion resistent lining include Carborundum Precast Carbofrax D, Carborundum Precast Alfrax 201 or their equivalent. A thermal insulation lining 106 may be placed between the shell and the lining 105 and between the manways and their respective erosion resistent linings when the separator is to be used in high temperatures service. Thus, process temperatures above 1500° F. (870° C.) can be used.

The detail of the separator 8 is more fully described in U.S. Letters Pat. No. 4,288,235 which is incorporated herein by reference.

EXAMPLE 1

An example of the hydrocarbon pretreatment process of the present invention as seen in FIG. 1 is as follows:

If Arabian Heavy Atmospheric Tower Bottoms (ATB) having API=12.6, Ramsbottom Carbon=13.3%, metals=125 ppm is fed to the reactor 6 at the following process conditions:

| | |
|---|---|
| reactor residence time = | 0.20 sec. |
| reactor temperature = | 1100° F. |
| reactor pressure = | 20 psig |
| regenerated solids T° = | 1300° F. |
| solids to feed ratio = (by wt.) | 8 |

The product yield in line 22 will be:

| | |
|---|---|
| $C_4$ and lighter | 3.1 |
| Gasoline | 7.1 |
| LGO | 8.0 |
| HGO | 76.1 |
| COKE | 5.7 |
| Metals in HGO | 8 ppm |

A conventional pretreatment process operated at 950° F., 2.5 seconds reactor residence time, 20 psig, steam to feed weight ratio of 0.2 will produce the following yield from the same feedstock:

| | |
|---|---|
| $C_4$ | 5.8 |
| Gasoline | 13.3 |
| LGO (400-650) | 15.0 |
| HGO (650+) | 55.25 |
| COKE | 10.64 |
| Metals in HGO | 11 ppm |

EXAMPLE 2

An example of the benefits of the close coupling process of FIG. 2 is seen from the following.

If the product from the pretreatment process of Example 1 according to this invention is delivered directly to the riser reactor 42 without quench and catalytically cracked under the following condition:

| | |
|---|---|
| Pretreated H/C to riser | 1100° F. |
| Catalytic solids | 1530° F. |
| Ratio by weight of catalyst to H/C | 1:1 |
| Reactor outlet temp. | 970° F. |
| Pressure | 20 psia |

Water is added to the riser reactor at a rate to provide a reactor outlet temperature of 970° F.

The yield of the catalytically cracked product compared with a conventional FCC process is:

| | FIG. 2 process | Conventional |
|---|---|---|
| $C_4$ and lighter | 17.1 | 19.1 |
| $C_5$ gasoline | 50.3 | 44.6 |
| LCO (400° F.-650° F.) | 17.4 | 14.3 |
| HCO (650° F.+) | 7.0 | 8.7 |
| Coke | 8.2 | 13.3 |

The benefits of the process of FIG. 2 are markedly enhanced by delivery of the thermally cracked product from the reactor 6 directly to the riser reactor 42 without quenching. The product entering the riser reactor 42 is vaporized and immediate catalytic cracking of the heavy hydrocarbon begins before coking.

We claim:

1. A process for pretreating heavy hydrocarbon feedstock for use as a feed in the production of liquid hydrocarbon fuels comprising the steps of:

(a) delivering the heavy hydrocarbon feedstock to a tubular thermal-pretreating reactor;

(b) delivering hot particulate solids to the tubular thermal-pretreating reactor;

(c) vaporizing the heavy hydrocarbon feed-stock at temperature between 1050° F. and 1200° F.; and a residence time of 0.05 to 0.20 seconds.

2. A process as in claim 1 further comprising the step of heating the particulate solids to a temperature up to 1800° F. by combusting the carbon formed on the particles during the pretreating reaction and delivering the particulate solids to the tubular thermal-pretreating reactor in a weight ratio to the heavy hydrocarbon feed of 3 to 60.

3. A process as in claim 1 wherein the heavy hydrocarbon is a residual oil.

4. A process as in claim 1 wherein the reaction products are quenched to a temperature below 850° F.

5. A process as in claim 1 wherein the reaction conditions comprise a solids to feed ratio by weight between 5 to 30 and the hydrocarbon feed is preheated to between 600° F. to 800° F.

6. A process as in claim 1 wherein the hydrocarbon feed is Arabian atmospheric tower bottoms and the reaction conditions comprise a temperature of about 1100° F.; a residence time of about 0.02 seconds; a reactor pressure of about 20 psig and a solids to feed ratio by weight of about 8.

7. A process as in claim 1 further comprising the step of immediately delivering the separated cracking gas from the thermal pretreating reactor to a catalytic cracker.

8. A process as in claim 7 wherein the process conditions in the catalytic cracker comprise a reactor outlet temperature of about 970° F.

9. A process as in claim 8 wherein the process conditions in the catalytic cracker comprise a reactor pressure of about 20 psig; the catalytic solids are at a temperature of 1530° F. when introduced to the catalytic reactor; the gas from the thermal pretreating reactor is at about 1100° F.; the ratio by weight of catalytic solids to the thermally pretreated gas feed to the catalytic reactor is about 1 and water is introduced to the catalytic reactor to maintain the catalytic cracking temperature at about 970° F.

10. A process as in claim 9 wherein the heavy hydrocarbon feed is a residual oil.

11. A process as in claim 1 wherein the hydrocarbon feed and hot particulate solids are delivered to the tubular cracking reactor through a reactor feeder having vertical passages communicating with the tubular cracking reactor and the solids in a hot solids vessel, means for providing localized fluidization to the solids above the vertical passages and means for delivering the heavy hydrocarbon to the tubular reactor at an angle to the path of the particulate solids entering the tubular reactor.

12. A process as in claim 1, wherein the particulate solids and the pretreated product gases are separated in a separator wherein the particulate solids pretreated product gases enter the separator through a separator inlet and change direction ninety degrees; the pretreated product gases change direction another ninety degrees to effect a one hundred and eighty degree reversal in direction from the entry direction; the particulate solids continue in the path oriented ninety degrees from the particulate solids-pretreated product gas separator inlet and thereafter, the path of the particulate solids is directed downwardly.

13. A process as in claim 1, wherein the particulate solids and pretreated product gases are separated in a separator comprising a chamber for rapidly disengaging about 80% of the particulate solids from the incoming mixed phase stream, said chamber having approximately rectilinear longitudinal side walls to form a flow path of height H and width W approximately rectangular in cross section, said chamber also having a mixed phase inlet of inside width $D_i$, a gas outlet, and a solids outlet, said inlet being at one end of the chamber and disposed normal to the flow path the height H of which is equal to at least $D_i$ or 4 inches, whichever is greater, and the width W of which is no less than 0.75 $D_i$ but no more than 1.25 $D_i$, said solids outlet being at the opposite end of the chamber and being suitably arranged for the downflow of discharged solids by gravity, and said gas outlet being therebetween at a distance no greater than 4 $D_i$ from the inlet as measured between respective centerlines and oriented to effect a 180° change in direction of the gas whereby resultant centrifugal forces direct the solid particles in the incoming stream toward a wall of the chamber opposite to the inlet forming thereat and maintaining an essentially static bed of solids, the surface of the bed defining a curvilinear path of an arc of approximately 90° of a circle for the outflow of solids to the solids outlet.

14. A process for pretreating heavy hydrocarbon feedstock for use as a feed in the production of liquid hydrocarbon fuels comprising the steps of:

(a) delivering the heavy hydrocarbon feedstock to a tubular thermal pretreating reactor;

(b) delivering hot particulate solids to the tubular thermal pretreating reactor;

(c) pretreating the heavy hydrocarbon feedstock at a temperature between 1050° F. and 1200° F.; and a residence time of 0.20 to 0.50 seconds wherein the heavy hydrocarbon feedstock is vaporized thereby forming a pretreated gas.

(d) separating the pretreated gas from the particulate solids;

(e) immediately delivering the separated pretreated gas from the thermal pretreating reactor to a catalytic reactor; and (f) catalytically cracking the pretreated effluent from the thermal cracking reactor.

15. A process as in claim 14 wherein the catalytic cracking conditions comprise a reactor outlet temperature of 950° F. to 1150° F.

16. A process as in claim 15 wherein the process conditions in the catalytic cracker comprise a reactor pressure of 0 to 350 psig; the catalyst solids delivered to the reactor are at a temperature of 1000° F. to 1700° F.; the ratio of catalytic solids to the thermally pretreated gas feed to the catalytic cracker is 0.1 to 20.

17. A process as in claim 14 wherein the catalytic cracking conditions comprise a catalytic reactor outlet temperature of about 970° F.; a reactor pressure of about 20 psig; the catalyst to solids are at a temperature of about 1530° F. when introduced to the catalytic reactor; the gas from the thermal pretreating reactor is about 1100° F.; the ratio by weight of catalytic solids to the thermally pretreated gas feed to the catalytic reactor is about 1 and water is introduced to the catalytic reactor to maintain the catalyst cracking temperature at about 970° F.

* * * * *